US012774574B2

(12) United States Patent
Helland

(10) Patent No.: US 12,774,574 B2
(45) Date of Patent: Oct. 27, 2026

(54) CONTAINMENT BOOM, SYSTEM, AND METHOD FOR CONFINING AN OIL SPILL

(71) Applicant: GB Ocean AS, Mandal (NO)

(72) Inventor: Per Martin Helland, Mandal (NO)

(73) Assignee: GB Ocean AS, Mandal (NO)

( * ) Notice: Subject to any disclaimer, the term of this patent is extended or adjusted under 35 U.S.C. 154(b) by 447 days.

(21) Appl. No.: 17/792,093

(22) PCT Filed: Feb. 2, 2021

(86) PCT No.: PCT/NO2021/050032
§ 371 (c)(1),
(2) Date: Jul. 11, 2022

(87) PCT Pub. No.: WO2021/158119
PCT Pub. Date: Aug. 12, 2021

(65) Prior Publication Data

US 2023/0047236 A1 Feb. 16, 2023

(30) Foreign Application Priority Data

Feb. 7, 2020 (NO) ..... 20200163
Nov. 6, 2020 (NO) ..... 20201209

(51) Int. Cl.
*E02B 15/08* (2006.01)

(52) U.S. Cl.
CPC ..... *E02B 15/0842* (2013.01); *E02B 15/0814* (2013.01); *E02B 15/0835* (2013.01); *E02B 15/085* (2013.01)

(58) Field of Classification Search
None
See application file for complete search history.

(56) References Cited

U.S. PATENT DOCUMENTS 3,925,991 A 12/1975 Poche
3,984,987 A * 10/1976 Light, Jr. ..... E02B 3/00 405/63

(Continued)

FOREIGN PATENT DOCUMENTS

AU 642077 10/1993
CN 101429760 5/2009

(Continued)

OTHER PUBLICATIONS

Norwegian Search Report for NO 20200163, dated Sep. 7, 2020.

(Continued)

*Primary Examiner* — Krishnan S Menon
(74) *Attorney, Agent, or Firm* — Andrus Intellectual Property Law, LLP

(57) ABSTRACT

A containment boom is for confining an oil spill within a restricted area on a water surface, wherein the containment boom has an openable link and connection means for connecting the containment boom at each side of the link to separate towing vessels. A system is for confining an oil spill having the containment boom and a storage means for storing the containment boom, wherein the storage means is configured to be situated at the perimeter of an offshore structure above the water surface, and wherein the lower part of the storage means is configured to be able to be opened and release the containment boom into the water upon deployment of the system. An offshore structure includes the system. A method is for confining an oil spill using the system.

17 Claims, 10 Drawing Sheets

(56) References Cited

U.S. PATENT DOCUMENTS

| | | | | |
|---|---|---|---|---|
| 4,076,624 | A * | 2/1978 | Tolan | E02B 15/08 405/71 |
| 5,051,029 | A | 9/1991 | Ecker | |
| 5,197,821 | A * | 3/1993 | Cain | E02B 15/0871 405/63 |
| 8,025,460 | B2 | 9/2011 | Cobb | |
| 2003/0141236 | A1 | 7/2003 | Nilsen | |
| 2009/0214288 | A1 | 8/2009 | Nesmith | |

FOREIGN PATENT DOCUMENTS

| | | | |
|---|---|---|---|
| DE | 2136619 | | 2/1972 |
| JP | S51135933 | U | 11/1976 |
| JP | S55126337 | U | 9/1980 |
| JP | 2007002617 | A | 1/2007 |
| NO | 317953 | | 1/2005 |
| NO | 20093557 | | 6/2011 |
| RU | 112217 | U1 * | 1/2012 |
| WO | 8001580 | | 8/1980 |
| WO | 9114830 | | 10/1991 |
| WO | 9601926 | | 1/1996 |
| WO | 2008/132461 | | 11/2008 |
| WO | 2011/074988 | | 6/2011 |

OTHER PUBLICATIONS

Norwegian Search Report for NO 20201209, dated Jun. 6, 2021.
International Search Report and the Written Opinion for PCT/NO2021/050032, dated Apr. 20, 2021.

* cited by examiner

CONTAINMENT BOOM, SYSTEM, AND METHOD FOR CONFINING AN OIL SPILL

CROSS-REFERENCE TO RELATED APPLICATIONS

This application is the U.S. national stage application of International Application PCT/NO2021/050032, filed Feb. 2, 2021, which international application was published on Aug. 12, 2021, as International Publication WO 2021/158119 in the English language. The International Application claims priority of Norwegian Patent Application Nos. 20200163, filed Feb. 7, 2020, and 20201209, filed Nov. 6, 2020. The international application and Norwegian applications are all incorporated herein by reference, in entirety.

FIELD

The invention relates to a containment boom, a system, and a method for confining an oil spill, and to an offshore structure comprising the system.

BACKGROUND

Oil spill in water, for example from offshore structures such as oil rigs, marine vessels, or offshore wind turbines, may cause serious pollution of very large regions. Containment booms can be used to confine the spilled oil to a restricted area on the water surface. They are therefore elongated to be able to fully or partly surround the spilled oil which is floating on the water surface. Containment booms typically comprise a light portion to make the boom float, so that oil will not leak above the boom, and a skirt which extends into the water to assure that the oil does not leak below the boom. The skirt will typically have a heavy weight at the bottom. The skirts may for example be screens which are permeable to water but substantially impermeable to oil.

Containment booms may be used as a safety installation on oil rigs or marine vessels such as ships. They can for example be positioned in suitable storage containers on the outer edge of the rig or ship, wherein the containers are configured to quickly release the containment booms in case an oil spill occurs. The containment booms will thereby fall into the water, and possibly automatically inflate when hitting the water.

Containment booms for such a use are disclosed in the documents US5051029A, AU642077B2, and WO8001580A1. The disclosed containment booms are configured to confine an oil spill to the region around the rig or ship so it can be cleaned up, for example by specific clean-up vessels, after the spill is stopped. However, a drawback of this solution is that the rig or ship may typically have to wait for the clean-up operation to be finished until they can resume the tasks they were doing. This process may be time consuming and require special cleaning equipment and/or vessels.

SUMMARY

The invention has for its object to remedy or to reduce at least one of the drawbacks of the prior art, or at least provide a useful alternative to prior art. The object is achieved through features, which are specified in the description below and in the claims that follow. The invention is defined by the independent patent claims, while the dependent claims define advantageous embodiments of the invention.

In a first aspect the invention relates more particularly to a containment boom for confining an oil spill within a restricted area on a water surface, the containment boom comprising an openable link and connection means for connecting the boom at each side of the link to separate towing vessels, wherein the openable link is remotely openable.

Initially, after the oil spill has been discovered and the containment boom has been deployed, the containment boom will typically be in a closed configuration which encircles the spilled oil and forms an oil-impermeable barrier around the oil-contaminated area. After the source of the oil spill has been identified and the leakage has been stopped, the oil which is already spilled must be cleaned up. The openable link and the connection means of the containment boom has the effect that the containment boom may be opened and towed to a different location by for example two towing vessels while the containment boom is in an open state. In this way the spilled oil may be moved away from the initial location, also if the containment boom is deployed around an offshore structure such as an oil rig. It is thereby not necessary to wait for the spilled oil to be cleaned up before the work on the rig can be resumed. Without the openable link and the connection means at each side of the link, it would not be possible to move the oil spill away from the rig. The connection means may for example be pennant lines, rope, or chains. There may typically be two connections means, one at each side of the link, for connecting to two separate towing vessels. The connection means may be connected at one end to the containment boom, while the other end of each connection means may then be connected to the towing vessels.

The containment boom should be able to be stored for several years and then immediately be able to function as intended, so reliability of the containment boom is of great importance.

An advantage of the openable link being remotely openable is that it is not required for any personnel to get close to the link to open it, which may be problematic in rough sea or hazardous oil spill.

In one embodiment, the openable link may be a weak link configured break open when a tension above a threshold value across the weak link is applied. The threshold value may for example be 5-20 tonnes, for example 10 tonnes. 1 tonne is equal to 9.8 kN. The threshold value may depend on the length and the strength of the containment boom and may for example be set to 5 tonnes per 100 m of containment boom. The optimum value may be determined for each specific case. A weak link may be very reliable and cheap, and. it may be designed in different ways. It may for example comprise a simple chain link, which will break above the threshold value, or it may be held together with a bolt which will break if subjected to a tension above the threshold value. The weak link may also comprise two complementary-shaped parts which engage each other as described in further detail below. Alternatively, the weak link may comprise one or more permanent magnets for holding the two ends of the containment boom together. The weak link will thereby open when a force greater than the magnetic force is applied. An advantage of using one or more permanent magnets is that the containment boom may easily be assembled again. In this way, if an oil spill occurs around e.g. a rig, the containment boom may be deployed from the rig, two towing vessels may move the containment boom and spilled oil away to a different location, and the containment boom may be closed again to confine the oil until a cleaning vessel arrive. A containment boom comprising a weak link with permanent magnets is also not required to be replaced after use, so there is a higher chance that the containment boom may be reused.

In one embodiment, the remotely openable link may comprise a pin bolt which holds the two ends of the containment boom together, for example by extending through eye bolts on each end of the containment boom. The remotely openable link may thereby be opened by pulling the pin bolt out of the eye bolts via a release rope, for example from the rig. The end of the pin bolt opposite the release rope may include a safety mechanism which prevents the pin bolt from escaping the eye bolts unintentionally, but which will allow the pin bolt to be released if a sufficient pulling force is applied on the pin from the release rope. The safety mechanism may for example include a pin extending perpendicularly through and protruding from the pin bolt, wherein the pin is constructed to break or bend if a force above a threshold value is applied. Alternatively, the safety mechanism may comprise a cap or similar with a larger radius than the bolt, wherein the cap is constructed to break or bend if a force above a threshold value is applied.

In one embodiment, the remotely openable link may comprise a remote release clamp connecting the ends of the containment boom, for example through eye bolts on each end of the boom, wherein the remote release clamp may be released from at least one of the eye bolts by pulling in a release rope. Such remote release clamps may be well known in the art. The remote release clamp may additionally comprise a safety pin which must be pulled out with an additional line before the release clamp can be released by the release rope.

In one embodiment, the two ends of the containment boom may be sewn together by a suitable fabric or rope, and the remotely openable link may comprise an electrically, hydraulically, or pneumatically operable cutting tool, such as a pair of scissors, which are adapted to cut the fabric or rope between the two ends of the containment boom to open the boom. The cutting tool may be activated either mechanically by pulling on a line, or electrically through a wire or using a wireless signal.

In one embodiment, the two ends of the containment boom may be held together by one or more electromagnet, whereby the remotely openable link may be opened by turning off the current to the electromagnet, for example achieved remotely via a cable.

The combination of the openable link and the connection means has the additional advantage that after the containment boom has been deployed, e.g. from a rig, the containment boom may be opened and allowed to drift with the water and spilled oil away from the rig by extending the connection means, for example by letting out line from a winch on the rig. This may be advantageous if the containment boom and/or spilled oil poses a problem for the rig and towing vessels are not available for moving the containment boom. The containment boom and confined oil may thereby float a safe distance from the rig while being connected to the rig with the connection means until the towing vessels are available and the connection means may be transferred to these towing vessel. A cleaning vessel may even clean up the spilled oil while the containment boom is connected to the rig without the need for separate towing vessel to move the containment boom and spilled oil further away from the rig.

In a second aspect, the invention relates more particularly to a system comprising the containment boom according the first aspect of the invention and a storage means for storing the containment boom, wherein the storage means is configured to be situated at a perimeter of an offshore structure above the water surface, and wherein the storage means is configured to be able to release the containment boom into the water upon deployment of the system. The offshore structure may for example be an oil rig, a ship, or an offshore wind turbine. The storage means may for example be a storage box for storing the containment boom inside, or a stand or frame for hanging the containment boom from. The system can thereby function as a safety measure for offshore structures where oil spill is a risk to decrease the contamination if an oil spill occurs. Upon detection of a spill from the offshore structure, the system may be deployed, whereby the containment boom will fall into the water from the perimeter of the offshore structure. The oil spill will thereby immediately be confined to an area within the containment boom, whereby the impact of the oil spill on the environment will be kept as low as possible. When the spilling has been stopped, the connection means can be delivered to two towing vessels, and the containment boom can be opened and used to transport the spilled oil away from the offshore structure for further cleaning, whereby any tasks performed by the offshore structure may be resumed.

The storage means may typically be configured to be positioned on the outside of the perimeter of the offshore structure, for example at least partly on a railing. In this way a release mechanism may be implemented relatively easily, for example by allowing the floor or bottom portion of the storage means to open when the system is deployed, thus allowing the containment boom to fall into the water due to gravity. Such a release mechanism may for example require only a relatively simple mechanism for holding the bottom portion of the storage means in the closed positioned. Different release mechanisms may be used, and the exact design of the release mechanism may be decided by the skilled person. The release mechanism may for example comprise bolts on at least one side of the storage means, wherein the bolts support the bottom portion. If the bolts are removed, the bottom portion will fall and release the containment boom. The bottom portion may comprise one or more hinges at one side, so that the bottom portion will be supported better, and it will open by rotation around the hinges to release the containment boom. The bottom portion may also be supported from below by a support rod, and the release mechanism may remove the support rod or cause it to stop supporting the bottom portion, for example by causing the support rod to collapse by removing a bolt which holds the support rod. The release mechanism may advantageously be remotely operable, whereby the crew on the bridge may deploy the system rapidly when an oil spill is detected.

In one embodiment, the system may comprise an oil sensor for being positioned at the water surface and for transmitting a signal if an oil spill is detected. The signal may inform the crew that an oil spill has occurred, whereby the crew may take the necessary actions, typically to deploy the system to confine the oil spill. The system may also be configured for automatically releasing the containment boom upon detection of an oil spill. This will assure rapid confinement of the oil spill and may be particularly advantageous in relation to unmanned offshore structures, for example offshore wind turbines, where there is no crew to deploy the system. In this case the signal from the oil sensor may advantageously be transmitted to a surveillance station so that the cleaning operation may be initiated. The system may preferably comprise at least two oil sensors for more reliable detection of oil and may for example be configured to be deployed only when at least two of the oil sensors detect oil. This will reduce the risk of an unnecessary deployment of the system due to a false positive signal from an oil sensor.

In one embodiment, the containment boom may be in a deflated configuration while stored by the storage means and configured to be automatically inflated upon deployment, for example when in contact with seawater. This may minimise the required size of the storage means while still assuring that the containment boom floats when in the water.

In one embodiment, the system may further comprise delivering means for delivering to separate towing vessels the ends of the connection means which are opposite to the containment boom. The delivering means may for example comprise a line thrower such as a pneumatic line thrower, slingshot-based line thrower, or a single-shot line-throwing gun which uses explosives for delivering the line. In this way the towing vessels may remain further from the containment boom during connection. This may be very advantageous for offshore structures since rough sea may make it unsafe for the towing vessels to sail close to the containment boom and the offshore structure. Additionally, the connection between the containment boom and the towing vessels may be established faster. A pneumatic line thrower may be able to deliver the connection means to towing vessels which are relatively far away from the offshore structure. The line thrower may typically be installed on the offshore structure, whereby the crew on the offshore structure can easily deliver the ends of the connection means to towing vessel outside the containment boom.

In a third aspect, the invention relates more particularly to an offshore structure comprising the system according to the second aspect of the invention.

In a fourth aspect, the invention relates more particularly to a method for confining an oil spill using the system according to the second aspect of the invention, wherein the method comprises the steps of: releasing the containment boom from the storage means; delivering to separate towing vessels the ends of the connection means which are opposite to the containment boom; and opening the link and moving the oil spill away from offshore structure by the towing vessels using the connection means.

In one embodiment, the step of delivering to separate towing vessels the ends of the connection means which are opposite to the containment boom may include using delivering means, for example a pneumatic line thrower.

BRIEF DESCRIPTION OF THE DRAWINGS

In the following is described an example of preferred embodiments illustrated in the accompanying drawings, wherein.

DETAILED DESCRIPTION OF THE DRAWINGS

Figure 1A:
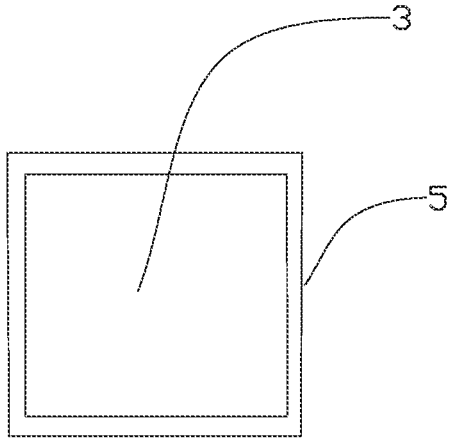
FIG. 1 shows an oil rig viewed from above with a storage means installed at the perimeter of the oil rig (FIG. 1A) and after a containment boom has been released (FIG. 1B)

In the drawings, the reference numeral 1 indicates a containment boom according to the invention. The drawings are shown in a schematic manner, and the features therein are not necessarily drawn to scale.

Figure 1B:
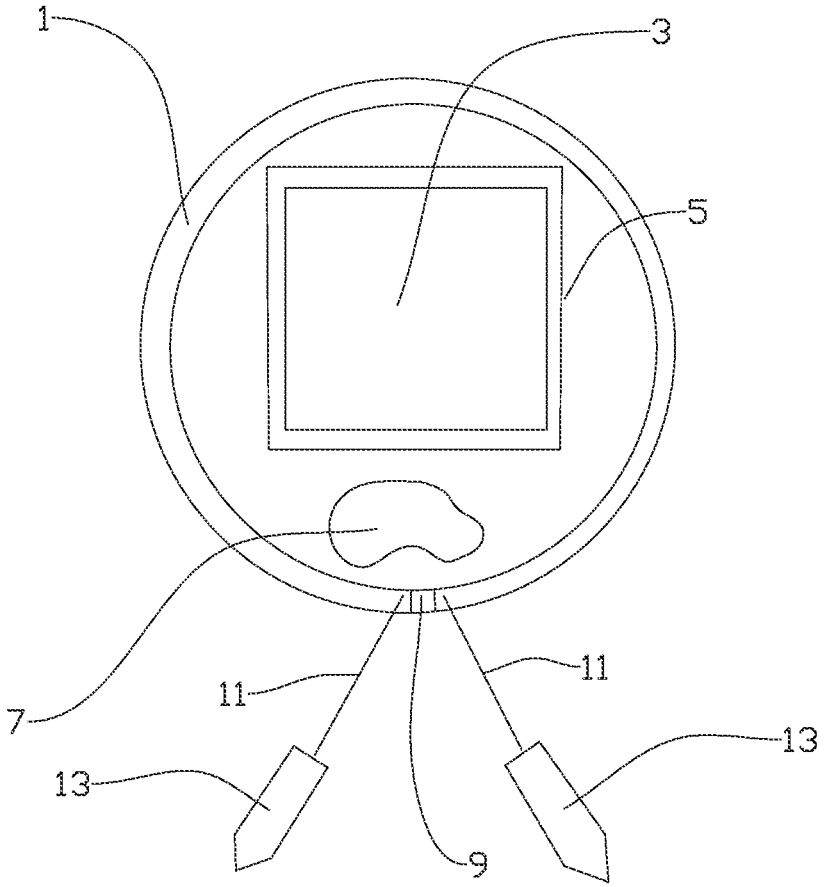

FIG. 1A shows an oil rig 3 viewed from above comprising a storage means 5 for a containment boom 1 (not visible in FIG. 1A). The storage means 5 is configured to be able to release the containment boom 1 quickly into the water, see for example FIG. 3. The storage means 5 is positioned along the entire perimeter of the oil rig 3 to be able to store a continuous containment boom 1. Thereby, as shown FIG. 1B, if an oil spill 7 has occurred, the containment boom 1 is released from the storage means 5 and falls into the water. The containment boom 1 thereby encircles the oil rig 3 and the spilled oil 7. The containment boom 1 comprises a weak link 9 which will open if a tension above a pre-set threshold is applied across the weak link 9. The containment boom 1 additionally comprises connection means 11, for example pennant lines, for connecting the containment boom 1 at each side of the weak link 9 to separate towing vessels 13. Towing vessels 13 can thereby open the containment boom 1 simply by pulling in the connection means 11, which will apply a tension across the weak link 9. Optionally, the connection means 11 may be delivered to the towing vessels 13 using delivery means such as pneumatic line throwers (not shown).

Figure 2:
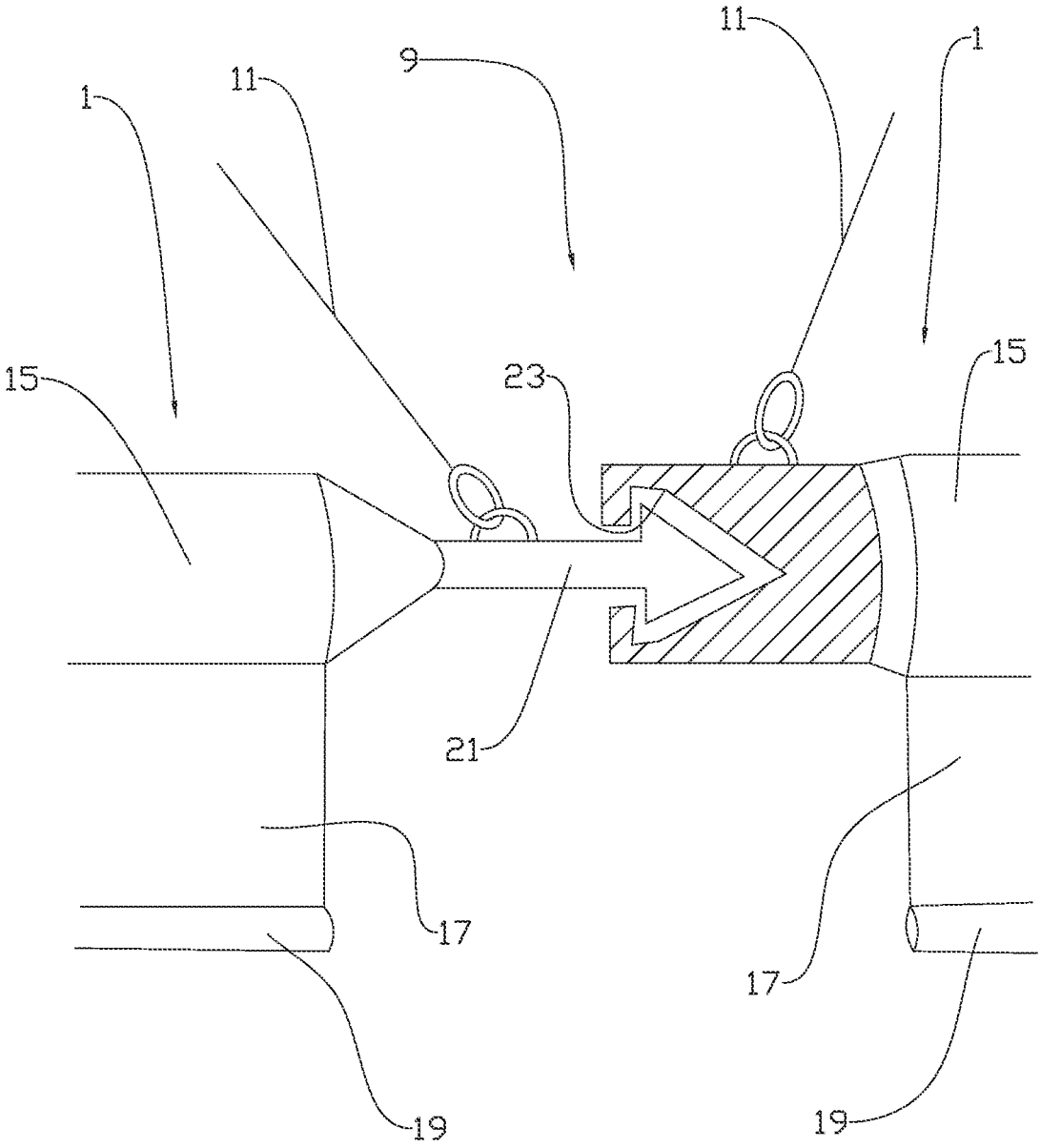
FIG. 2 shows, on a larger scale, an embodiment of the remotely openable link in the form of a weak link in the containment boom.

FIG. 2 shows, on a larger scale, a possible design of the weak link 9 in the containment boom 1. The containment boom 1 comprises a floatable portion 15, which is configured to emerge above the water surface to prevent spilled oil from escaping above the containment boom 1, and a skirt 17 configured to extend to a pre-set depth below the water surface to prevent spilled oil from escaping below the containment boom 1. The floatable portion 15 may for example be inflated with air or another gas to float, whereby it may be in a deflated state to save space when it is not yet deployed. The skirt 17 comprises a weight 19, which is denser than water, at the bottom end to ensure that the skirt 17 extends into the water. Such a design is typical for a containment boom 1 and is not especially related to the shown design of the weak link 9. The weak link 9 comprises at one side an arrow-shaped portion 21 which is inserted into a complementary-shaped recess 23 at the other side (shown with its cross-section in the figure to make the recess 23 visible). The recess 23 is shaped such that the arrow-shaped portion 21 cannot escape, unless a tension above a pre-set threshold is applied across the weak link 9, whereby the weak link 9 will open. The weak link 9 may for example be constructed to break if the threshold is exceeded, or the arrow-shaped portion 21 may be constructed in a material which allows it to deform elastically if the threshold is exceeded. If it opens by temporary elastic deformation, the weak link 9 has the advantage that it may be closed again and reused, for example after the oil spill 7 has been moved. The tension across the weak link 9 may be applied by pulling in the connection means 11 connected at each side of the weak link 9.

Figure 3A:
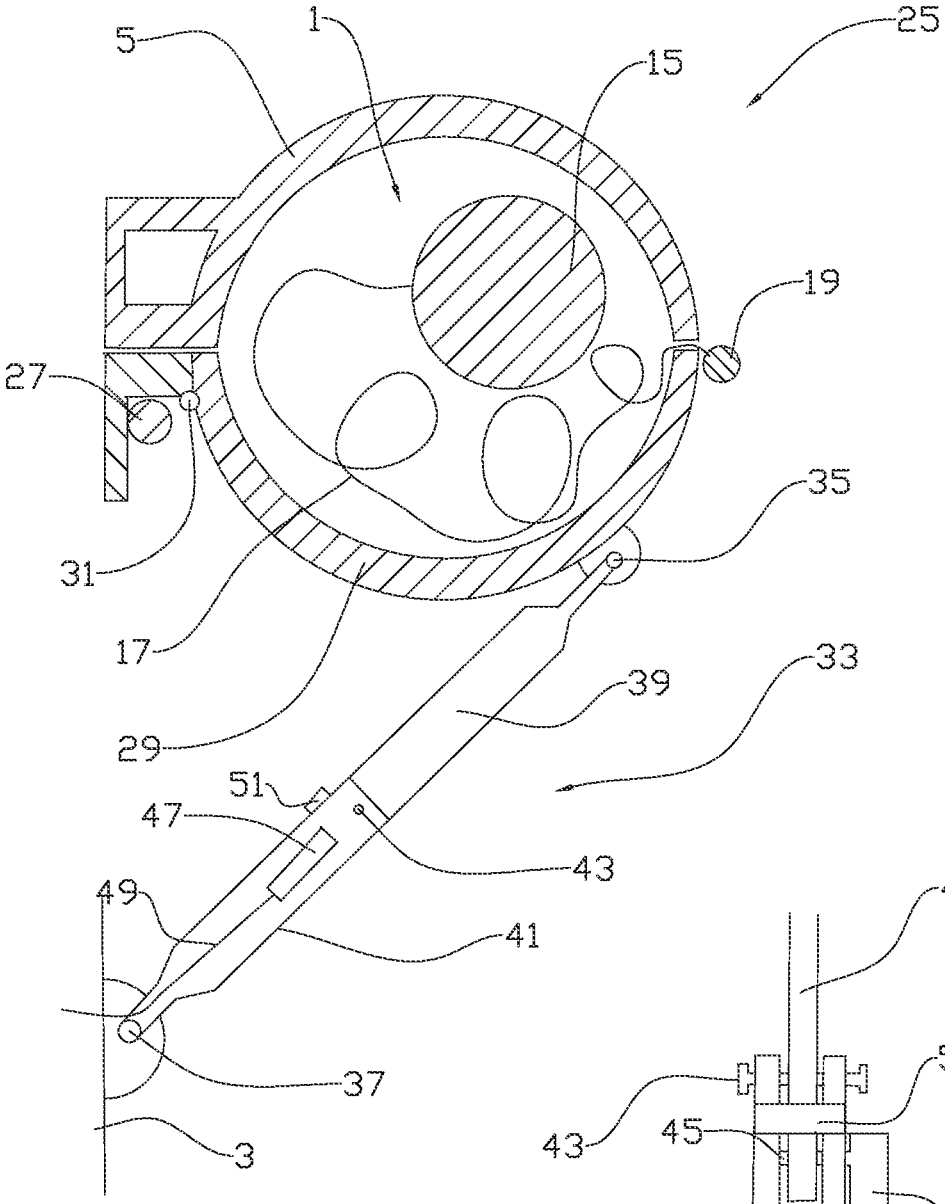
FIG. 3 shows a cross-sectioned view of an embodiment of system according to the second aspect of the invention (FIG. 3A), with the release mechanism viewed from a different angle (3B)
Figure 3B:
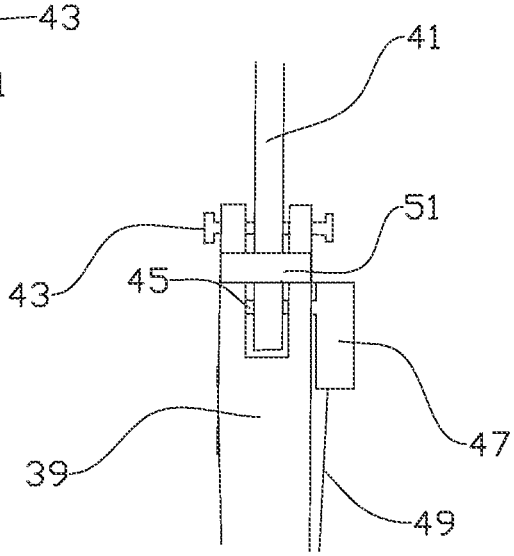

FIG. 3A shows a cross-sectioned view of a system 25 according to the second aspect of the invention comprising a containment boom 1 within a storage means 5, here in the form of a storage box. The containment boom 1 comprises a floatable portion 15, a skirt 17, and a weight 19 as shown in FIG. 2 and described above. The storage means 5 is in the shown embodiment attached to a railing 27 of an oil rig 3. The bottom portion 29 of the storage means 5 is rotatably attached at one side via a hinge 31 and is supported by a support rod 33 extending from the storage means 5 and connected to the oil rig 3 further below. The support rod 33 is rotatably attached at both the first end 35, which is attached to the bottom portion 29 of the storage means 5, and the second end 37, which is attached to the oil rig 3. The support rod 33 comprises a first portion 39 and a second portion 41 which are rotatably connected through a bolt 43 which extends through both portions 39, 41 of the support rod 33, see also FIG. 3B. A second bolt 45, which is controlled by a releaser 47, ensures that the two portions 39, 41 do not rotate relative to each other around the bolt 43. The releaser 47 is remotely controlled via a cable 49. If an oil spoil occurs and the system 25 is to be deployed, the second bolt 45 is removed by the releaser 47. The two portions 39, 41 of the support rod 33 are thereby free to rotate around the points 35, 43, and 37 which causes the support rod 33 to bend and the bottom portion 29 of the storage means 5 to fall down while rotating around the hinge 31. A plate 51 on the second portion 41 ensures that the support rod 33 can only bend in the desired direction. The containment boom 1 will thereby fall out of the storage means 5 and into the water. The weight 19 of the containment boom is positioned such that it is the first part of the containment boom 1 which starts falling, thereby assuring that the weight 19 reaches the water first and does not end above the floatable portion 15.

Figure 4:
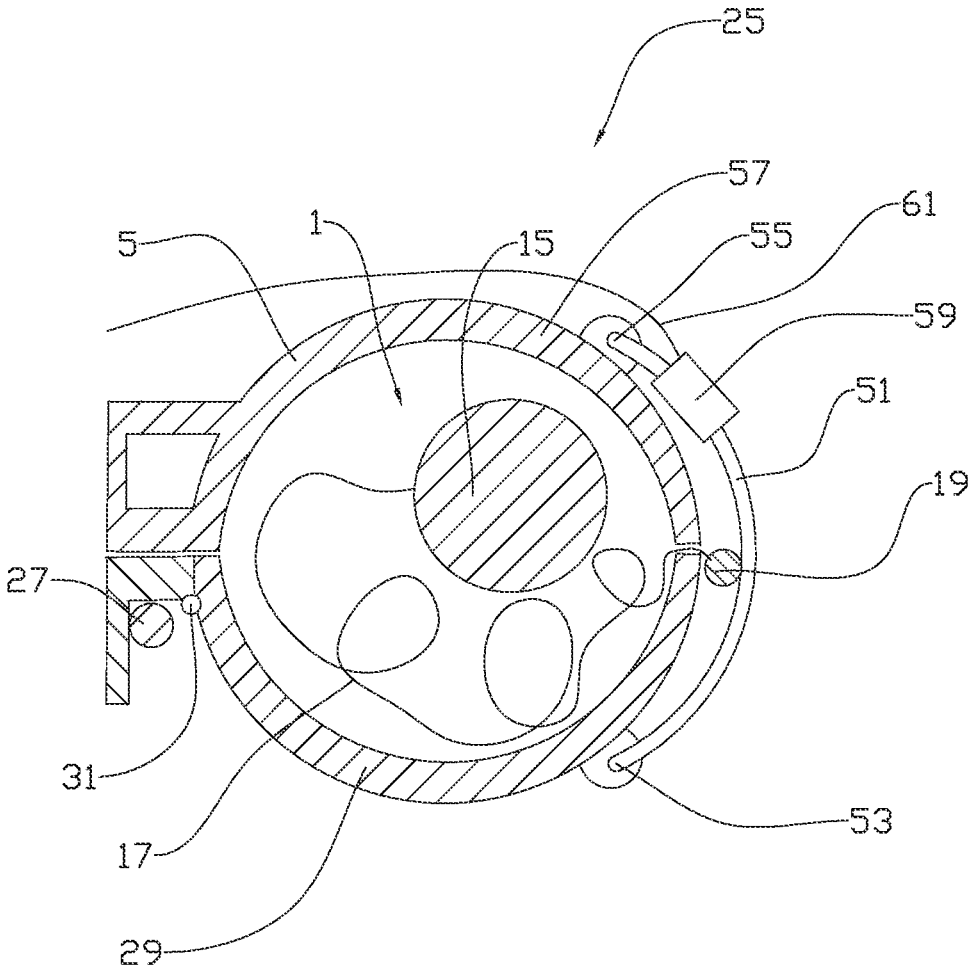
FIG. 4 shows a cross-sectioned view of another embodiment of the system according to the second aspect of the invention.

FIG. 4 shows another embodiment of the system 25 according to the second aspect of the invention. The system 25 is similar to the embodiment shown in FIG. 3A, but the release mechanism is different. In FIG. 4, the bottom portion 29 of the storage means 5, which is still rotatably attached at one side via a hinge 31, is held closed via for example a rope 51 strapped between a point 53 on the lower portion 29 of the storage means 5 and a point 55 on the upper portion 57 of the storage means 5. The rope 51 may also be e.g. a belt. A release unit 59 is configured to cut the rope 51 upon recieval of a signal, whereby the bottom portion 29 of the storage means 5 will rotate around the hinge 31 and release the containment boom 1. The release unit 59 may be of a type known in the art and may be activated for example electrically through a cable 61. The release unit 59 may additionally be configured to activate automatically and release the containment boom 1 if subjected to an increased pressure, for example due to hydrostatic pressure of the water if the offshore structure is sinking, as this may cause an increased risk of oil spill.

Figure 5:
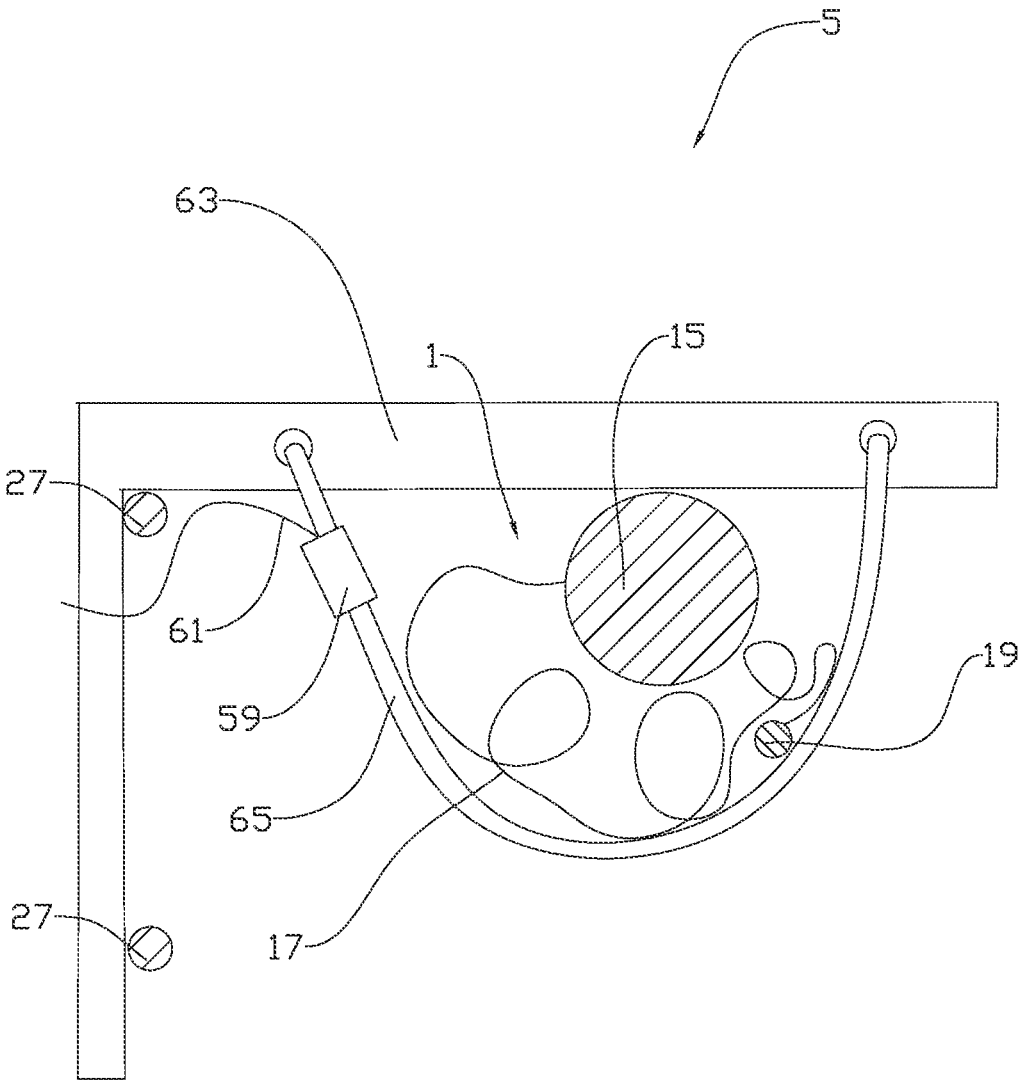
FIG. 5 shows another embodiment of the system according to the second aspect of the invention.

FIG. 5 shows another embodiment of the system 25 according to the second aspect of the invention. In this embodiment, the storage means 5 comprises a frame 63, and the containment boom 1 is tied to the frame 63 by a rope 65 or similar. The frame 63 can for example be attached to a railing 27. A release unit 59 is configured to cut the rope 65 upon recieval of a release signal through the cable 61. When the rope 65 is cut, the containment boom 1 is free to fall into the water below. Several frames 63 and ropes 65 may be positioned around the perimeter of the offshore structure.

Figure 6:
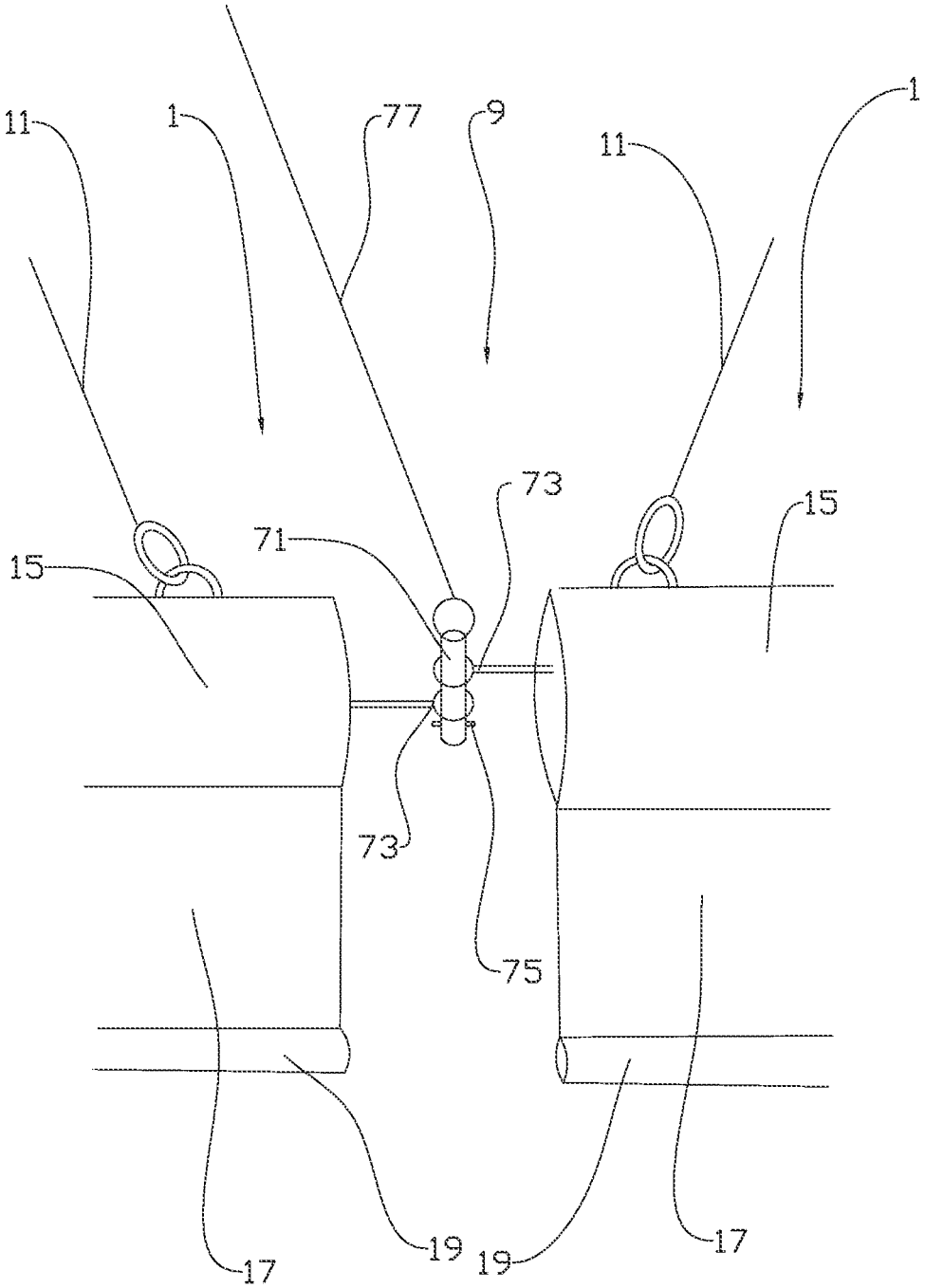
FIG. 6 shows, on the same scale as in FIG. 2, an embodiment of the remotely openable link comprising a pin bolt.

FIG. 6 shows a remotely openable link 9 comprising a pin bolt 71 which holds the two ends of the containment boom 1 together by extending through eye bolts 73 on each end of the containment boom 1. The remotely openable link 9 may thereby be opened by pulling the pin bolt 71 out of the eye bolts 73 via a release rope 77, for example from a rig. The end of the pin bolt 71 opposite the release rope 77 includes a safety pin 75 which prevents the pin bolt 71 from escaping the eye bolts 73 unintentionally. The safety pin 75 is constructed to break or bend if a force above a threshold value is applied by pulling on the release rope 77, whereby the pin 71 bolt is removed and the link 9 opened.

Figure 7:
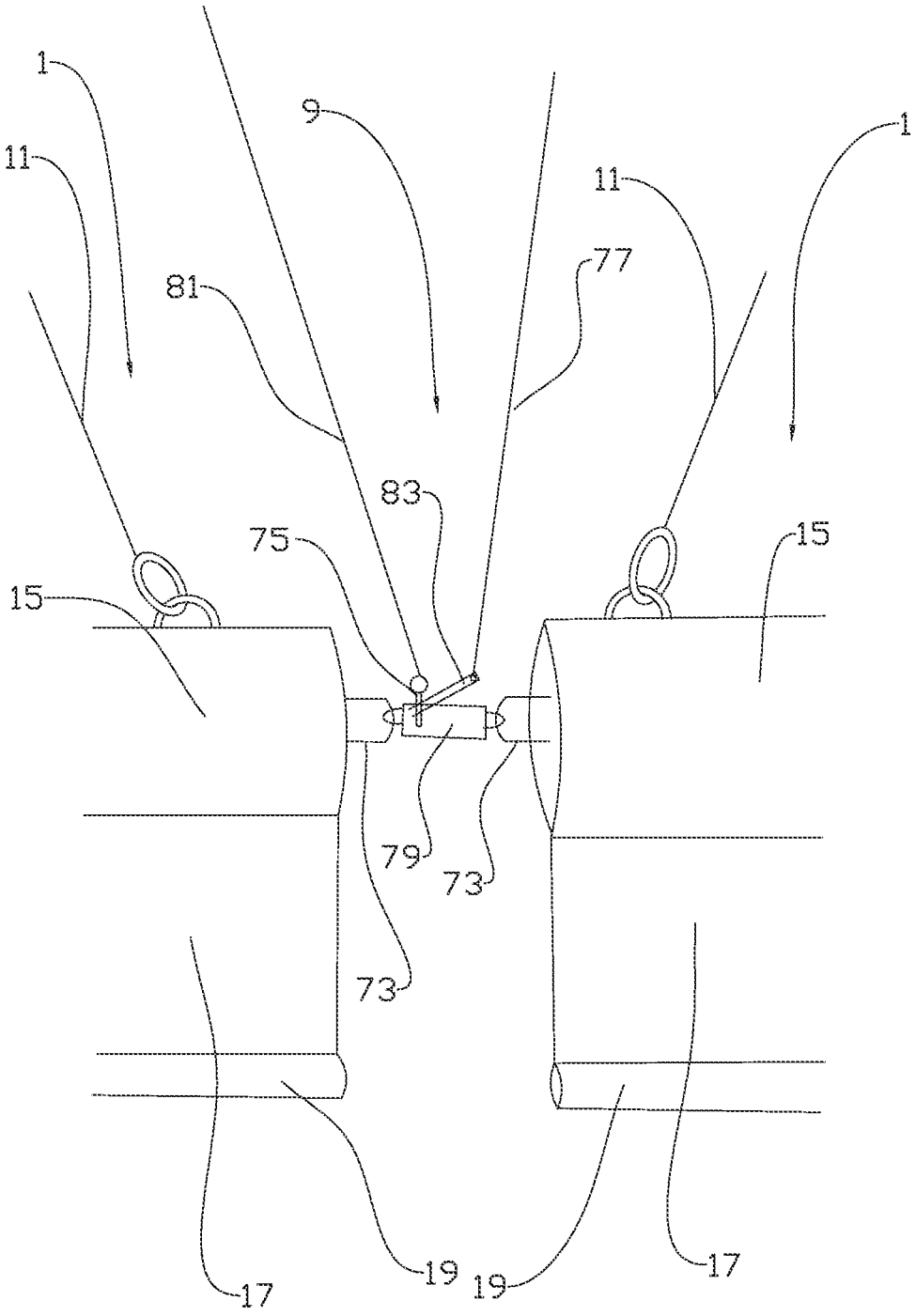
FIG. 7 shows on the same scale an embodiment of the remotely openable link comprising a remote release clamp.

FIG. 7 shows a remotely openable link 9 comprising a remote release clamp 79 connecting eye bolts 73 on each end of the containment boom 1, wherein the remote release clamp 79 may be released from at least one of the eye bolts 73 by pulling in a release rope 77. The remote release clamp 77 additionally comprises a safety pin 75 which must be pulled out with an additional safety line 81 before the release clamp 79 can be released by the release rope 77. The remote release clamp 79 comprises a release lever 83 whereon the release rope 77 pulls.

Figure 8:
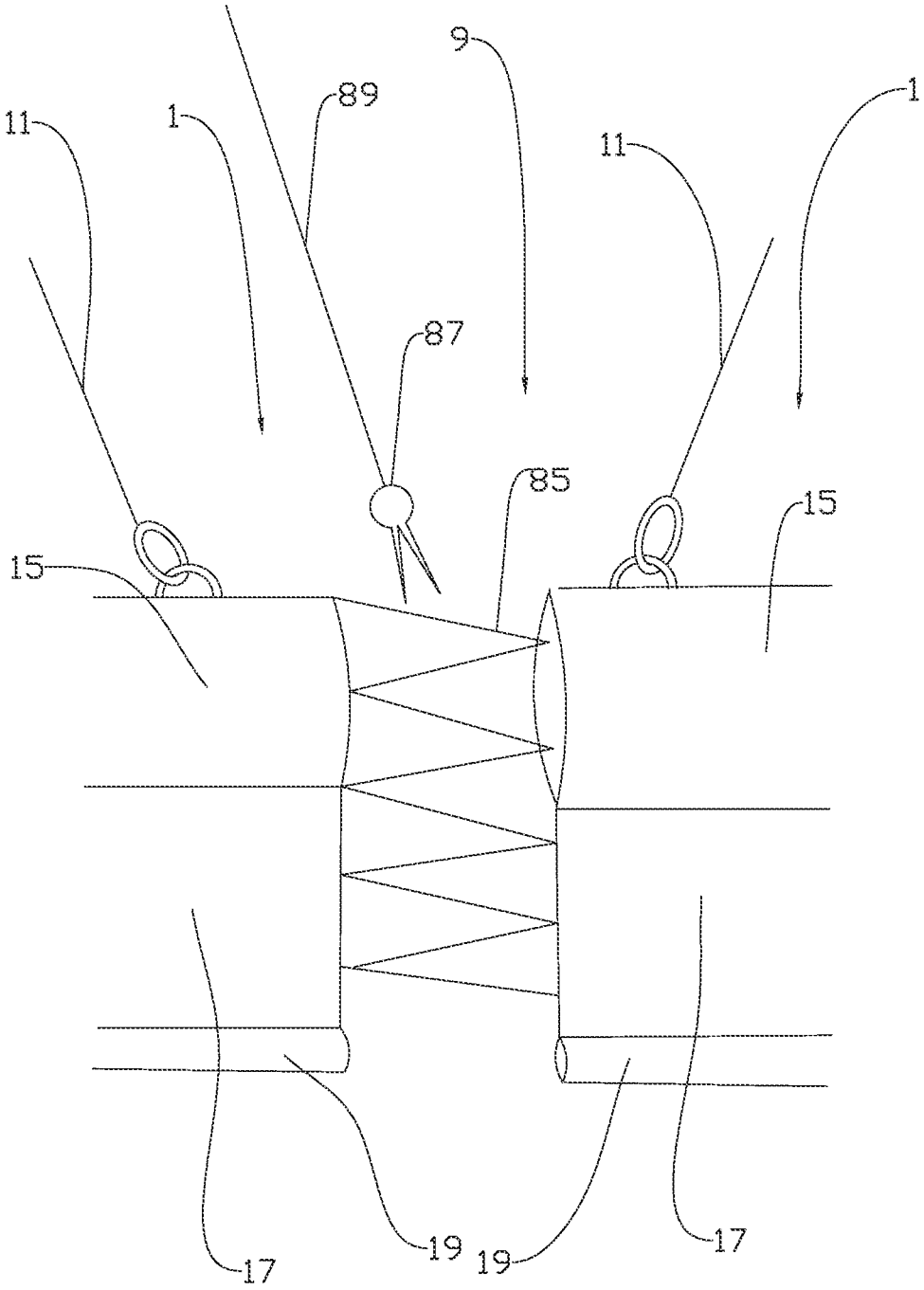
FIG. 8 shows on the same scale an embodiment of the remotely openable link comprising a cutting tool.

FIG. 8 shows a remotely openable link 9 wherein the two ends of the containment boom 1 are sewn together by a rope 85, and wherein an electrically operable cutting tool 87, shown as a pair of scissors, is adapted to cut the rope 85 between the two ends of the containment boom 1 to open the boom 1. The cutting tool 87 is activated through a wire 89.

Figure 9:
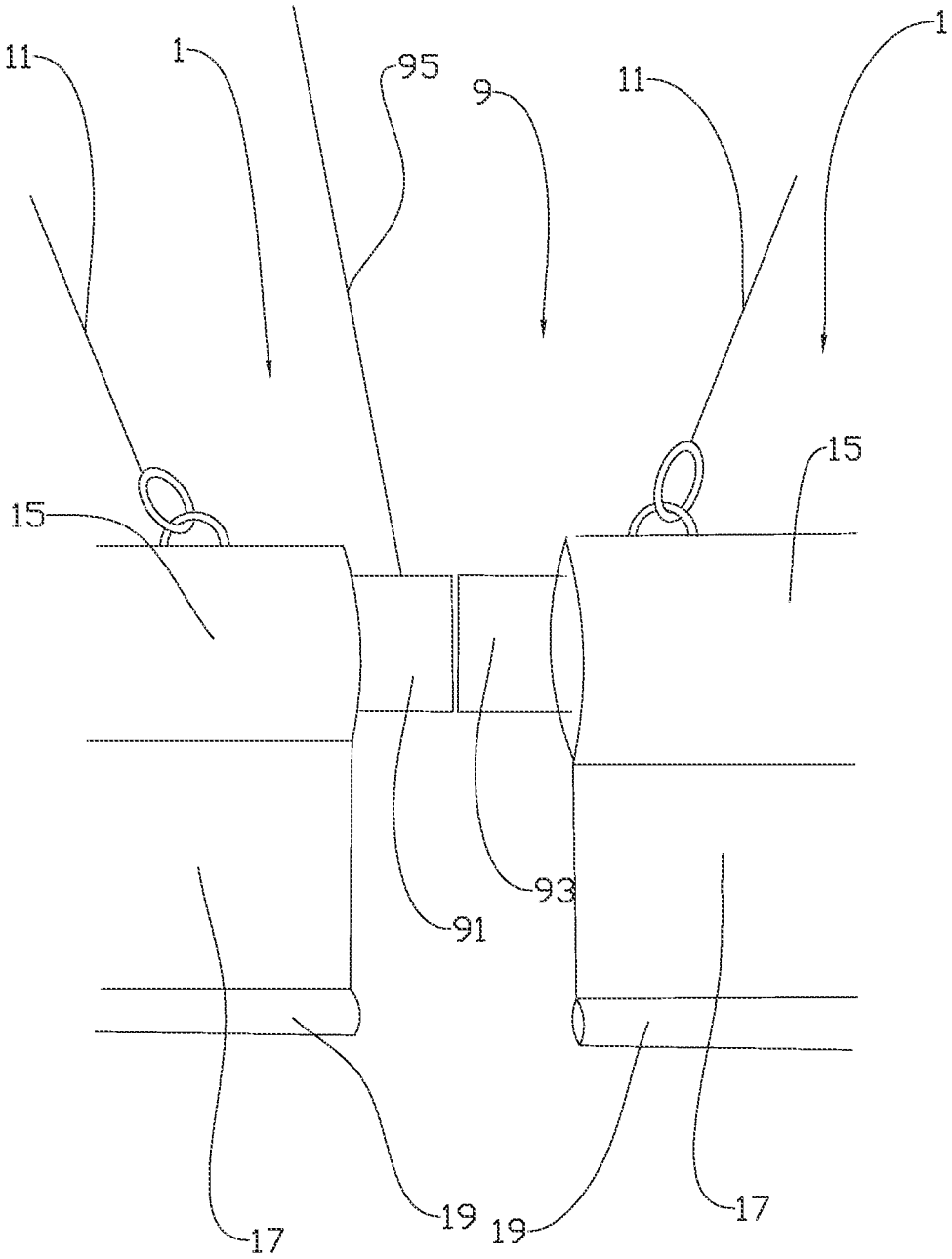
FIG. 9 shows on the same scale an embodiment of the remotely openable link comprising an electromagnet.

FIG. 9 shows a remotely openable link 9 wherein the two ends of the containment boom 1 are held together by an electromagnet 91 at one end which acts on a suitable metal or alloy 93 at the other end of the containment boom 1. The remotely openable link 9 may be opened by turning off the current to the electromagnet 91 via a cable 95, whereby the magnetic force is eliminated.

Figure 10:
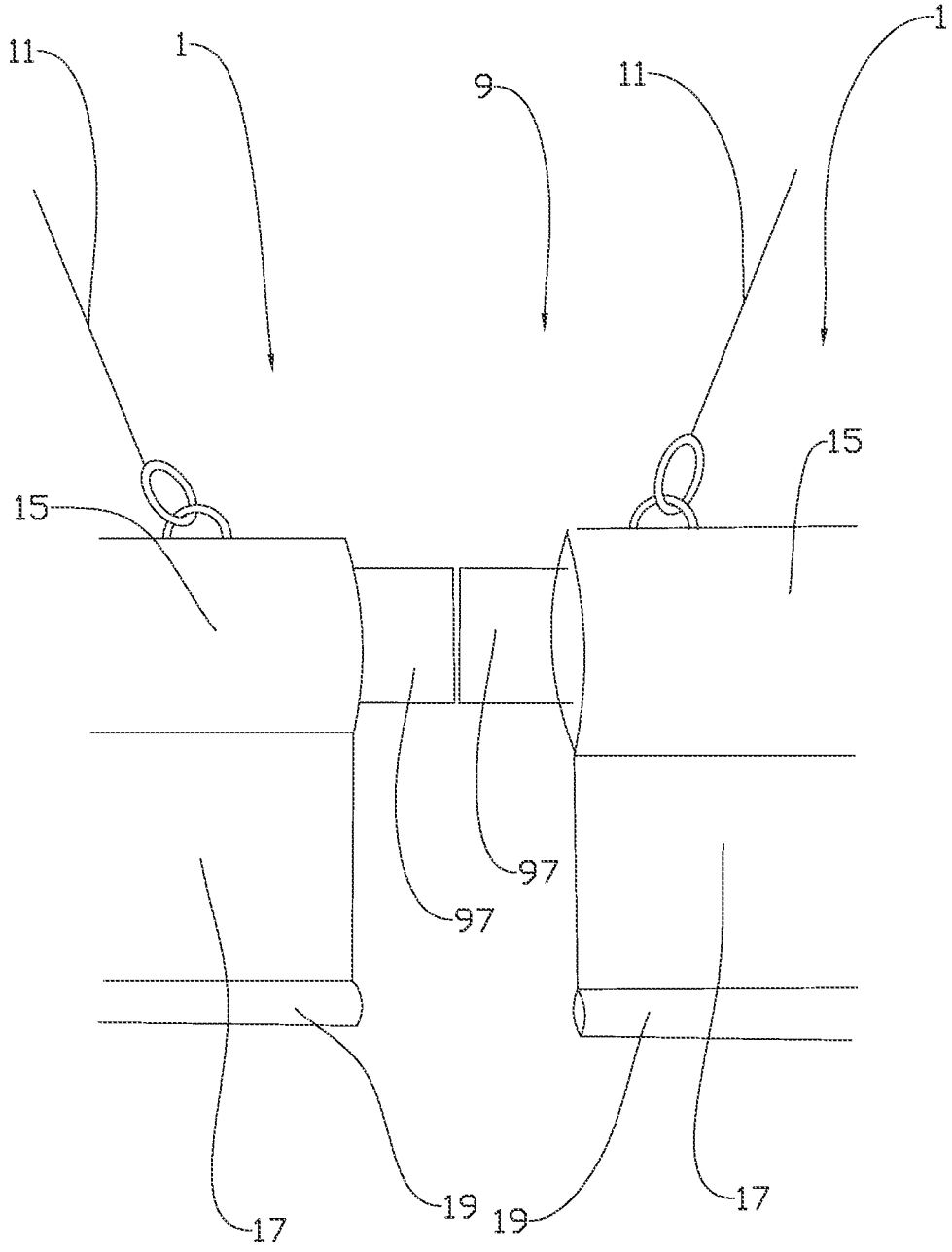
FIG. 10 shows on the same scale an embodiment of the remotely openable link comprising two permanent magnets.

FIG. 10 shows a remotely openable link 9 wherein the two ends of the containment boom 1 are held together by two permanent magnets 97, one at each end of the containment boom 1. This remotely openable link 9 is also a weak link, since the link will open if a predetermined threshold value which is greater than the magnetic force is applied. An advantage of a weak link 9 using magnets 97 is that it may easily be closed again.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The invention claimed is:

1. A system for confining an oil spill in water, the system comprising a containment boom, the containment boom to define a perimeter around an area in which an oil spill is to be confined, wherein the containment boom comprises an openable link configured to link between one portion of the boom along a first length of the perimeter and another portion of the boom along a second length of the perimeter and connection means for connecting the one portion of the containment boom one side of the openable link and the other portion of the containment boom other side of the openable link to separate towing vessels, wherein the openable link is remotely openable and the openable link is a weak link configured to break open when a tension above a threshold value across the weak link is applied, and a storage means for storing the containment boom, wherein the storage means is configured to be situated at a perimeter of an offshore structure above a surface of the water, and wherein the storage means is configured to be able to release the containment boom into the water upon deployment of the system, and wherein the containment boom is deployable to encircle the offshore structure in operational use.

2. The system according to claim 1, wherein the system comprises an oil sensor for being positioned at the surface of the water and for transmitting a signal if an oil spill is detected.

3. The system according to claim 2, wherein the system comprises at least two oil sensors.

4. The system according to claim 1, wherein the containment boom is in a deflated configuration while stored by the storage means and configured to be automatically inflated upon deployment.

5. The system according to claim 1, wherein the system further comprises a delivering means for delivering to separate towing vessels ends of the connection means which are opposite to the containment boom.

6. The system according to claim 5, wherein the delivering means comprises a pneumatic line thrower.

7. An offshore structure comprising a system for confining an oil spill in water, the system comprising a containment boom, the containment boom to define a perimeter around an area in which an oil spill is to be confined, wherein the containment boom comprises an openable link configured to link between one portion of the boom along a first length of the perimeter and another portion of the boom along a second length of the perimeter and connection means for connecting the one portion of the containment boom one side of the openable link and the other portion of the containment boom other side of the openable link to separate towing vessels, wherein the openable link is remotely openable and the openable link is a weak link configured to break open when a tension above a threshold value across the weak link is applied, and a storage means for storing the containment boom, wherein the storage means is configured to be situated at a perimeter of an offshore structure above a surface of the water, and wherein the storage means is configured to be able to release the containment boom into the water upon deployment of the system, and wherein the containment boom is deployable to encircle the offshore structure in operational use.

8. A method of operating the system according to claim 1 to confine an oil spill in water, the method comprising the steps of:

releasing the containment boom from the storage means;

delivering to separate towing vessels ends of the connection means which are opposite to the containment boom; and opening the openable link and moving the oil spill away from offshore structure by the separate towing vessels using the connection means.

9. The method according to claim 8, wherein the system further comprises delivering means for delivering to separate towing vessels the ends of the connection means which are opposite to the containment boom, and wherein the step of delivering to separate towing vessels the ends of the connection means which are opposite to the containment boom includes using the delivering means.

10. The system according to claim 4, wherein the openable link of the containment boom is in a closed configuration while the containment boom is stored by the storage means and is configured to remain closed upon deployment and automatic inflation.

11. The system according to claim 1, wherein the storage means is configured to be situated along the entire perimeter of the offshore structure, and the containment boom is configured to surround the entire perimeter of the offshore structure upon deployment.

12. The system according to claim 1, wherein the storage means is configured to release the entire containment boom substantially simultaneously upon deployment.

13. The system according to claim 3, wherein the system further comprises delivering means for delivering to separate towing vessels ends of the connection means which are opposite to the containment boom.

14. The system according to claim 1, wherein the connection means includes two magnets that are attracted to each other by a magnetic force that keeps the openable link closed, and wherein the openable link is configured to open upon application of a predetermined threshold force that is greater than a magnetic force that otherwise keeps the openable link closed.

15. The system according to claim 7, wherein the openable link is configured to open upon application of a predetermined threshold force that is greater than a magnetic force that keeps the openable link closed, and wherein the openable link is configured to open upon application of a predetermined threshold force that is greater than a magnetic force that otherwise keeps the openable link closed.

16. The method according to claim 8, further comprising opening the openable link by applying a force to the openable link that is greater than a magnetic force and that otherwise keeps the openable link closed.

17. The method according to claim 16, further comprising remotely causing the openable link to open via the force.

* * * * *